US008695685B2

(12) United States Patent
Eichholz et al.

(10) Patent No.: US 8,695,685 B2
(45) Date of Patent: Apr. 15, 2014

(54) METHOD AND DEVICE FOR PRODUCING STEEL STRIPS BY MEANS OF BELT CASTING

(75) Inventors: Hellfried Eichholz, Ilsede (DE); Jochen Wans, Meerbusch (DE); Karl-Heinz Spitzer, Clausthal-Zellerfeld (DE); Hans-Jürgen Hecken, Schuld (DE)

(73) Assignee: SMS Siemag Aktiengesellschaft, Düsseldorf (DE)

( * ) Notice: Subject to any disclaimer, the term of this patent is extended or adjusted under 35 U.S.C. 154(b) by 0 days.

(21) Appl. No.: 13/380,944

(22) PCT Filed: May 7, 2010

(86) PCT No.: PCT/DE2010/000551

§ 371 (c)(1),
(2), (4) Date: Jan. 27, 2012

(87) PCT Pub. No.: WO2010/149125

PCT Pub. Date: Dec. 29, 2010

(65) Prior Publication Data

US 2012/0125557 A1 May 24, 2012

(30) Foreign Application Priority Data

Jun. 26, 2009 (DE) ..... 10 2009 031 236

(51) Int. Cl.
*B22D 11/06* (2006.01)

(52) U.S. Cl.
USPC ..... 164/479; 164/429; 164/505

(58) Field of Classification Search
USPC ..... 164/462, 463, 475, 479, 505, 415, 423, 164/429
See application file for complete search history.

(56) References Cited

U.S. PATENT DOCUMENTS

| | | | | |
|---|---|---|---|---|
| 4,610,296 | A * | 9/1986 | Hiratake et al. | 164/469 |
| 5,651,413 | A * | 7/1997 | Williams et al. | 164/479 |
| 5,836,377 | A * | 11/1998 | Reichelt et al. | 164/486 |
| 7,891,407 | B2 * | 2/2011 | Schlichting et al. | 164/452 |
| 2012/0043049 | A1 * | 2/2012 | Klinkenberg et al. | 164/471 |

FOREIGN PATENT DOCUMENTS

| | | | |
|---|---|---|---|
| EP | 0312572 | Y | 4/1988 |
| JP | 60187448 | Y | 9/1985 |
| JP | 62077155 | Y | 4/1987 |
| JP | 62161443 | Y | 7/1987 |
| JP | 2034254 | Y | 2/1990 |

* cited by examiner

*Primary Examiner* — Kevin P Kerns
(74) *Attorney, Agent, or Firm* — Lucas & Mercanti, LLP; Klaus P. Stoffel

(57) ABSTRACT

A method and a device for producing steel strips by belt casting, wherein a molten metal is output from a feed vessel onto a circulating casting belt of a horizontal belt casting system under protective gas by a gutter and a siphon-like outlet area designed as a casting nozzle. At least one plasma jet, which renders the area of action inert and heats the area of action, influences the outlet-side area of the casting nozzle and the molten metal exiting therefrom at least during the casting process. For this purpose, at least one plasma torch, which produces a plasma jet and is directed at the outlet area of the casting nozzle in a direction opposite the casting direction, is provided.

17 Claims, 2 Drawing Sheets

METHOD AND DEVICE FOR PRODUCING STEEL STRIPS BY MEANS OF BELT CASTING

The present application is a 371 of International application PCT/DE2010/000551, filed May 7, 2010, which claims priority of DE 10 2009 031 236.6, filed Jun. 26, 2009, the priority of these applications is hereby claimed and these applications are incorporated herein by reference.

BACKGROUND OF THE INVENTION

The invention concerns a method and device for producing steel strip by belt casting.

A method of this general type for producing steel strip by belt casting is already known (Steel Research 74 (2003), No. 11/12, pp. 724-731). In particular, this method of production, which is known as the DSC method, is suitable for producing hot rolled strip from light-gage steel.

In the known method, molten metal is fed from a feed vessel onto a revolving casting belt via a pouring spout and a siphon-like outlet area designed as a casting nozzle. Intensive cooling of the casting belt causes the poured molten metal to solidify into a near-net strip with a thickness of 6-20 mm. After complete solidification, the near-net strip is subjected to a hot rolling process.

To realize uniform distribution of the melt on the casting belt, several jets of an inert gas in the form of a rake distributed over the width are directed towards the melt bath against the direction of conveyance in the feed area.

A disadvantage of this belt casting installation is that during the operation caking can develop in the outlet-side area of the casting nozzle, which, causes greater and greater reduction of the outlet cross section. This leads to unequal feeding of the molten steel onto the belt and thus to casting defects.

Studies on the cause of the caking have shown that, for one thing, the lower temperature at the casting nozzle compared to the molten metal first makes the formation of deposits possible, and for another, the ceramic casting nozzle is wetted by oxides that form on the surface of the melt as the melt emerges and continue to adhere there and then form an ideal surface for further growth of the caking deposits.

The caking deposits form especially in the critical triple point of ceramic casting nozzle, revolving casting belt and liquid metal melt and in areas with unfavorable flow conditions.

SUMMARY OF THE INVENTION

The objective of the invention is to create a method for producing steel strip in which the problems described above are avoided or at least greatly reduced. A further objective is to create a device for carrying out the method of the invention.

According to the disclosure of the invention, at least one plasma jet, which heats and renders inert the action area, acts on the outlet-side area of the casting nozzle and on the molten metal emerging from it, at least during the casting process.

The method of the invention is basically suitable for producing hot rolled strip from a wide variety of metal materials, including especially light-gage steels, such as, for example, high-manganese HSD® steels.

Tests revealed that the action of a plasma jet on the outlet area of a casting nozzle and on the surface of the emerging molten metal effectively prevents the development of caking. This effect is due to the great chemical activity, the highly effective inerting, and the heating.

The operating times and thus the economy of the belt casting installation as well as the quality of the cast strip can be significantly increased in this way.

The plasma is ignited by means that are already well known by high voltage or with high frequency, inductively or capacitively, in the torch itself or against the molten metal and is maintained with direct current or alternating current. The strength (intensity) of the plasma is advantageously adjusted by means of a control set consisting of a gas mixture controller, a pressure controller and a volume controller and of a control unit for the electrical parameters.

A well-defined temperature input in the area of the casting nozzle can be adjusted by means of the well-controllable power of the plasma and the high temperature of the plasma, in order, for example, to balance the temperature profile in the casting ladle or the temperature gradient during casting.

In order to achieve inerting and thus avoid the formation of oxides on the melt surface, which could lead to subsequent caking on the casting nozzle, it is advantageous to use an inert gas, e.g., argon or nitrogen, as the process gas.

However, besides argon and nitrogen, it is also possible to use other individual gases or gas mixtures with additions of $H_2$, CO, $CO_2$, or $CH_4$ as well as other combinations.

The surface (surface tension) of the metal film can be very well controlled by the ability to adjust the inerting in a well-defined way. For example, the presence of hydrogen is very effective at preventing oxidation of the surface of the molten metal.

The inerting of the outlet area and systematic temperature control of the metal film provide advantageous means of influencing the flow behavior of the metal film and thus the wettability of the ceramic with the aim of avoiding caking deposits.

Accretions in the especially critical triple point of ceramic casting nozzle, casting belt and liquid metal melt can be advantageously prevented with the method of the invention.

As is already known from the prior art, a nozzle-like element realized as an argon rake is arranged in front of the casting nozzle to achieve uniform distribution of the liquid steel on the casting nozzle.

In a first advantageous embodiment of the invention, the argon rake is modified in such a way that one or more plasma torches can be realized as a complete assembly integrated in the system side by side or one after another in the direction of molten metal flow. In this regard, the plasma torches are positioned in such a way that they can act over the entire width of the casting nozzles, including especially the edge region. The use of several torches is advantageous, because the efficiency of the inerting and heating can be increased in this way.

In a second advantageous embodiment, the plasma torches act on sectors of the outlet-side area of the casting nozzle, such that optimum heating of the casting nozzle over its width or over the width of the emerging molten metal bath can be undertaken by means of systematic separate temperature control of the individual torches.

In accordance with the invention, the assembly is manufactured from a material with good thermal conductivity, e.g., copper, and is intensively cooled with water.

However, it is also possible to arrange the plasma torches independently of the argon rake if this seems to make more sense for the individual application.

It is advantageous for the direction of the jets of the plasma torches against the casting direction to be adjusted slightly downward towards the liquid steel in order also to be able to have a systematic influence on the surface of the molten metal bath. For this reason, in the edge regions of the casting nozzle, the plasma torches are also oriented slightly in the direction of the edge region of the emerging melt.

The method of the invention is explained in greater detail below with reference to the drawings.

DETAILED DESCRIPTION OF THE INVENTION

Figure 1:
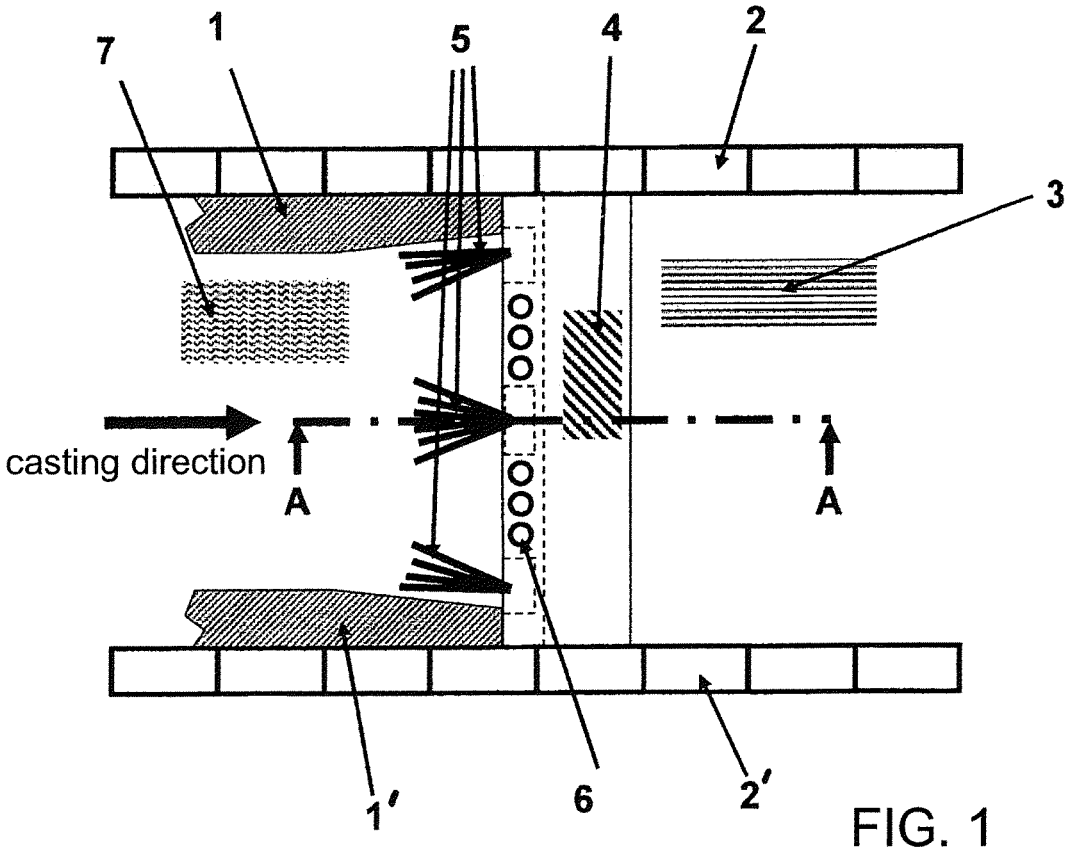
FIG. 1 is a schematic representation of the region of the casting nozzle of a belt casting installation according to the invention in a top view.

In FIG. 1 we see in a top view a schematic representation of the region of the casting nozzle of a belt casting installation according to the invention.

In this drawing, metal melt 7 flows from left to right, as indicated by an arrow.

Figure 2:
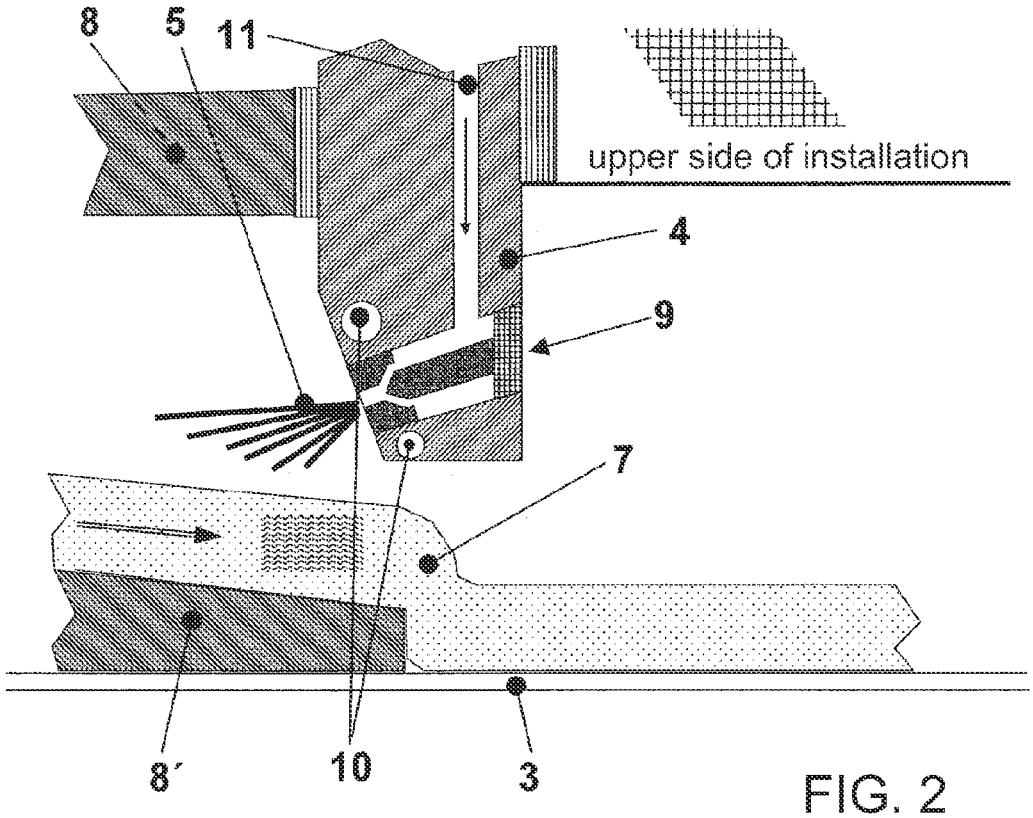
FIG. 2 is a side view of the same installation.

In the area of the exit of the metal melt 7 from the casting nozzle, the drawing shows a copper assembly 4 of the invention, which consists of an argon rake for uniform distribution of the melt on the surface of the casting belt 3 and plasma torches 9 (FIG. 2).

The plasma torches 9 are arranged in such a way that their plasma jets 5 can completely inert both the outlet area of the metal melt 7 from the casting nozzle and the surface of the melt and can control the temperature of the melt.

To realize uniform distribution of the melt on the casting belt 3, the nozzles 6 of the argon rake are directed obliquely downward towards the metal melt 7.

FIG. 2 shows a side view of the region of the casting nozzle according to section A-A in FIG. 1. This view shows the ceramic upper part 8 and likewise ceramic lower part 8' of the casting nozzle.

The assembly 4 with argon rake and plasma torches 9 is arranged in the area in which the metal melt 7 emerges from the casting nozzle in such a way that, on the one hand, the nozzles 6 (FIG. 1) of the argon rake uniformly distribute the emerging metal melt on the casting belt 3 and, on the other hand, the plasma jets 5 of the plasma torches 9 can completely inert the outlet area.

In accordance with the invention, to allow systematic temperature control of the molten metal 7, the plasma torches 9 are inclined in the direction of the emerging molten metal.

The plasma torches 9 are cooled by water fed through cooling water bores 10 and are supplied with plasma gas through a plasma gas feed line 11.

Not shown are the electric supply lines for the plasma torches, which are integrated in the assembly 4.

LIST OF REFERENCE NUMBERS

1, 1' side pieces of the casting nozzle
2, 2' side bounds of the casting belt
3 casting belt
4 assembly comprising the argon rake and plasma torches
5 plasma jets
6 nozzle-like element
7 metal melt
8, 8' upper and lower part of the casting nozzle
9 plasma torch
10 cooling water bores
11 plasma gas feed line

The invention claimed is:

1. A method for producing steel strip by belt casting, comprising the steps of: feeding a metal melt under a protective gas from a feed vessel via a pouring spout and a siphon-like outlet area designed as a casting nozzle having an upper part and a lower part onto a revolving casting belt of a horizontal belt casting installation; and, producing at least one plasma jet, using a plasma torch arranged in the outlet area between the upper part and the lower part, in a direction opposite a casting direction, which heats and renders inert an action area, so as to act on an outlet-side area inside of the casting nozzle and on a metal melt emerging from the casting nozzle, at least during a casting process.

2. The method in accordance with claim 1, wherein several plasma jets act on sectors of the entire outlet-side area of the casting nozzle and on the metal melt emerging from the casting nozzle.

3. The method in accordance with claim 2, including controlling power and temperature of the plasma jet that is produced sector by sector.

4. The method in accordance with claim 1, including using an inert gas or a gas mixture that contains an inert gas for producing the plasma.

5. The method in accordance with claim 4, including using argon or nitrogen as the inert gas.

6. The method in accordance with claim 4, including using an inert gas with additions of $H_2$, CO, $CO_2$, or $CH_4$ as the gas mixture.

7. The method in accordance with claim 1, wherein action of the plasma jet allows systematic control of temperature of the emerging metal melt and makes possible a balancing of a temperature gradient that develops from the feed vessel to the outlet area of the casting nozzle.

8. The method in accordance with claim 1, including systematically controlling surface tension and viscosity of the metal melt emerging from the casting nozzle.

9. The method in accordance with claim 1, wherein the plasma jet starts acting on the outlet area of the casting nozzle before a start of a casting operation.

10. A device for producing steel strip by belt casting, comprising: a feed vessel containing a metal melt and having a horizontally disposed pouring spout and a siphon-like outlet area designed as a casting nozzle having an upper part and a lower part; a primary cooling zone with two guide pulleys and a cooled revolving casting belt; and at least one plasma torch arranged in the outlet area between the upper part and the lower part so as to produce a plasma jet directed towards the outlet area and inside of the casting nozzle in a direction opposite a direction of casting.

11. The device in accordance with claim 10, wherein several plasma torches that are distributed over a width of the casting nozzle and act on individual sectors of the casting nozzle are arranged so that the plasma jets cover the entire width of the casting nozzle.

12. The device in accordance with claim 11, wherein the plasma torches are arranged one after another in a direction of molten metal flow.

13. The device in accordance with claim 10, wherein the plasma torch and the at least one nozzle-like element are installed separately.

14. The device in accordance with claim 13, wherein the plasma torch and the at least one nozzle-like element are each water-cooled.

15. The device in accordance with claim 10, wherein the direction of the jet of the plasma torch towards the outlet area of the casting nozzle is inclined in a direction of the metal melt.

16. A device for producing steel strip by belt casting, comprising: a feed vessel containing a metal melt and having a horizontally disposed pouring spout and a siphon-like outlet area designed as a casting nozzle; a primary cooling zone with two guide pulleys and a cooled revolving casting belt; and at least one plasma torch that produces a plasma jet directed towards the outlet area of the casting nozzle in a direction opposite a direction of casting, further comprising at least one nozzle-like element, designed as a rake that utilizes an outflow of several gas jets of an inert gas for realizing uniform distribution of the molten metal on the casting strip, arranged in an area of delivery of the metal melt onto the casting belt, wherein the plasma torches and the at least one nozzle-like element are combined in one assembly.

17. The device in accordance with claim 16, wherein the assembly is water-cooled.

* * * * *